United States Patent [19]

Leydorf, Jr. et al.

[11] Patent Number: 4,708,105

[45] Date of Patent: Nov. 24, 1987

[54] CHAMBER CONSTRUCTION FOR INTERNAL COMBUSTION ENGINE

[75] Inventors: George F. Leydorf, Jr., Birmingham; Michael A. Pulick, Livonia, both of Mich.

[73] Assignee: Ford Motor Company, Dearborn, Mich.

[21] Appl. No.: 812,205

[22] Filed: Dec. 23, 1985

[51] Int. Cl.[4] ..... F02F 1/10; F02F 1/18

[52] U.S. Cl. ..... 123/193 CH; 123/41.74; 123/41.84; 123/90.27

[58] Field of Search ..... 123/41.72, 41.74, 41.83, 123/41.84, 90.27, 90.33, 90.34, 193 C, 193 CH, 193 CP, 195 C, 196 R, 196 M

[56] References Cited

U.S. PATENT DOCUMENTS

| | | | |
|---|---|---|---|
| 3,691,914 | 9/1972 | Reisacher et al. | 123/193 CH X |
| 4,230,087 | 10/1980 | Abe et al. | 123/193 CH |
| 4,446,827 | 5/1984 | Kubozuka | 123/193 C X |
| 4,606,304 | 8/1986 | Krüger et al. | 123/193 CH X |

FOREIGN PATENT DOCUMENTS

| | | | |
|---|---|---|---|
| 2012762 | 10/1971 | Fed. Rep. of Germany | 123/193 C |
| 2501605 | 7/1975 | Fed. Rep. of Germany | 123/193 CH |
| 1222939 | 2/1971 | United Kingdom | 123/193 C |
| 2142087 | 1/1985 | United Kingdom | 123/193 CH |

*Primary Examiner*—Willis R. Wolfe, Jr.
*Attorney, Agent, or Firm*—Joseph W. Malleck; Roger L. May

[57] ABSTRACT

A construction for an internal combustion engine is disclosed which improvies engine performance, reduces the cost of assembly and manufacture, and reduces engine weight. The construction comprises: (a) a cast iron monoblock having a bank of aligned cylinders with the axes of the cylinders lying in a common central upright plane, the monoblock being closed at the top except for means permitting ingress and egress of combustion gases to or from the cylinders; (b) a pair of die cast aluminum complementary clamshell housing sections having margins mateable along the central upright plane effective to support and envelop the monoblock in spaced relation therein to define a water jacket chamber, the sections having a cast-in-place oil passage system defined in and along the margins mateable at the central upright plane; (c) means (grooves and compressible sealing rings) extending between the sections and monoblock to seal the water jacket chamber against oil and water migration; (d) means extending annularly about the monoblock and received by the housing sections to transfer cylinder axial thrust loads therebetween; and (e) means to fixedly joint the sections together in the mated relationship.

14 Claims, 4 Drawing Figures

CHAMBER CONSTRUCTION FOR INTERNAL COMBUSTION ENGINE

BACKGROUND OF THE INVENTION

1. Field of the Invention

This invention relates to the art of constructing internal combustion engines and particularly to the construction of the combustion chamber, valve train chamber, and crankcase chamber for such engines.

2. Description of the Prior Art

Substantially all commercial engine housings are made as metal castings. In making cast metal engine housings for automobiles, it is conventional to split the housing configuration along a horizontal plane to define a separate cylinder block and a separate head, both pieces being clamped together under high force with an intervening gasket therebetween to assure combustion gas and water tightness. These clamping forces are substantial and are implemented usually by use of several long bolts which extend from the head into deep threaded bores of the block. The forces must be sufficiently great to withstand the separating forces caused primarily by gas pressure in the combustion chambers. The great clamping forces in turn may cause slight distortion of the roundness of the cylinder bores and straightness of the valve guides, which translates into higher frictional forces because ring forces must be increased to distort the rings to accommodate out-of-roundness and higher frictional forces against valve stems during reciprocal movement. The engine durability may be adversely affected over long usage.

Making engine housings to mate along a horizontal surface demands that considerable coring be used to define internal passages that do or do not interface with the horizontal mating surface; the cored passages not being directly accessible to cleaning and removal of casting fins or debris. Moreover, techniques of making such cast blocks and heads require that certain other passages be separately machined after the castings are complete, which adds considerable cost to the manufacture of such items. Increased weight is undesirable from a fuel economy standpoint. Thus, it can be seen that the horizontally split engine construction is in need of some improvement in the areas of weight, cost, quality, automation and effect on engine performance.

Some attempt has been made to reduce weight in such horizontally split engines by substituting cast aluminum for all or part of the cast iron housing portions. But aluminum suffers from an inability to withstand wear at high temperatures and abrasive wear in a manner equivalent to that of cast iron so that numerous inserts of improved properties must usually be provided at points where excessive wear would occur. Aluminum is also less likely to withstand the problem of undue clamping forces. Automating the assembly of a horizontally split engine has not proved to be entirely satisfactory because several subassemblies of such horizontally split engine must be cradled in separately defined journals, yokes and supports which in turn must be separately mounted and separately assembled, complicating the steps of assembly and inhibiting assembly robotically.

SUMMARY OF THE INVENTION

The invention is a construction for an internal combustion engine which improves engine performance and fuel economy, reduces the cost of assembly and manufacture, assures more uniform quality, and reduces the weight of such an engine compared to conventional internal combustion engines in use today.

The construction comprises: (a) a cast metal wear resistant monoblock having a bank of aligned cylinders with the axes of the cylinders lying in a common central plane, the monoblock being closed at the top except for means permitting ingress and egress of combustion gases to or from the cylinders; (b) a pair of cast metal complementary clamshell housing sections having margins mateable along said central plane effective to support and envelop the monoblock in spaced relation therein to define a water jacket chamber, the sections having a cast-in-place oil passage system defined in and along the margins mateable at said central plane; (c) means extending between the sections and monoblock to seal the water jacket chamber against oil and water migration; (d) means extending annularly about the monoblock and received by the housing sections to transfer cylinder axial thrust loads therebetween, and (e) means to fixedly join the sections together in the mated relationship.

Preferably, the central plane is upright, the monoblock is comprised of cast iron or ceramic and the complementary clamshell housing sections are comprised of die cast aluminum. Preferably, the means to fixedly join the sections together comprises (i) at least one annular continuous groove in the perimeter of a section, (ii) resilient adhesive in the groove, and (iii) supplementary mechanical fasteners effective to draw the sections tightly together to prevent peel-mode failure of the adhesive.

Preferably, the means to seal the water jacket chamber comprises continuous opposed compression surfaces disposed respectively on the sections and monoblock located (a) continuously along the top and bottom perimeter of the water jacket chamber transverse to the central upright plane, and (b) along the perimeter of the water jacket chamber that lies in the central upright plane, and compressible continuous sealing members disposed between such compression surfaces to complete the sealing function. Advantageously, the transverse compression surfaces comprise a continuous groove loop respectively in the top and bottom of the monoblock and a continuous lip surface on both sections, disposed generally opposite one of said grooves when the sections are in the assembled position about the monoblock. The compression surfaces along the upright plane comprise a continuous groove in the mating surface of at least one of the sections and a continuous facing surface on the mating surface of the other of said sections. Continuous interconnected O-rings are preferably disposed between the grooves and surfaces to complete the sealing function; the continuous groove loop at the top of the monoblock may encircle the bank of valve guides and the lower loop may encircle the bank of cylinders at or near the base skirt thereof.

Advantageously, the clamshell sections may be aluminum die cast in a manner to define integral camshaft bearing surfaces, integral crankshaft bearings, and an extension housing effective to enclose camshaft drive members. Preferably, the aluminum die cast sections may also be adapted to receive plastic members which are bonded thereto by adhesives such as a plastic oil pan; a plastic intake manifold may be bonded to the cast iron monoblock.

Preferably, the aluminum die cast clamshell sections are held together with a bonding force of at least 30 psi and no greater than 110 psi.

DETAILED DESCRIPTION AND BEST MODE

Figures 1, 3, 4:
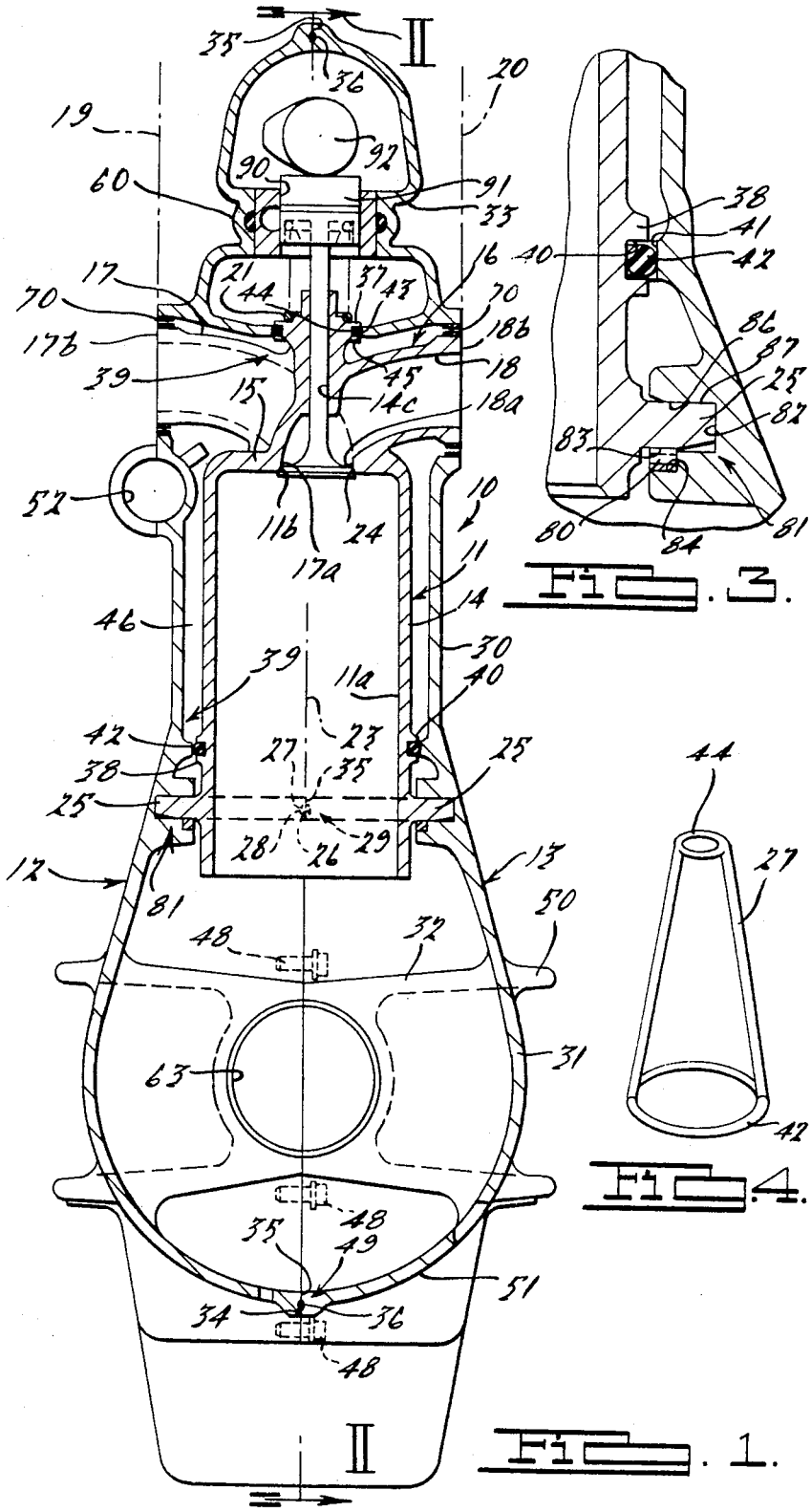
FIG. 1 is a sectional elevational view of an internal combustion engine embodying the principles of this invention.
FIG. 3 is an enlarged view of a portion of FIG 1.
FIG. 4 is an elevational view of a prefabricated unit of sealing members used to seal the water jacket chamber.

The improved construction of this invention comprises a three piece internal combustion engine to define the combustion chambers, camshaft case, water jacket, timing chain case and crankshaft case. The three pieces comprise a monoblock 11, preferably comprised of cast iron, a left cast metal clamshell section 12, and a right cast metal clamshell section 13. The monoblock is designed to carry all of the critical high temperature and/or abrasive wear surfaces for the engine, comprising cylinder bores 11*a*, valve seats 11*b*, and valve guides 11*c*. The clamshell sections are advantageously comprised of die cast aluminum for lower weight and cost, and more economical manufacture. They define, in an integral manner, the camshaft case 33, water jacket 30, crankshaft case 31, and timing chain case 9 (see FIG. 2).

Monoblock

As shown more particularly in FIG. 1, the monoblock is comprised of a cast iron member having a bank of cylinders 14 (arranged in-line with their axes on a central plane 23), each being closed at the top 15 of the cylinders except for the presence of means 16 permitting ingress and egress of combustion gases to or from the cylinders. Means 16 comprises one or more intake elbows 17 extending from the top of the cylinder at 17*a* to an exit opening 17*b* lying in a plane 19 parallel to the central upright plane 23 of the in-line cylinders. Similarly, an exhaust elbow 18 extends from the top of the cylinders at 18*a* to an exit opening 18*b* lying in a plane 20 parallel to the central upright plane. Valve guides 21 having central openings carrying valve guide surface 11*c* for valve stems to operate therein, and, in one mode, are arranged to lie with their axes along the central plane and interposed between the intake and exhaust elbows.

Clamshell Housing Sections

Each of the clamshell sections have mating margins (34–35 respectively) which when brought together adjoin at the central upright plane 23 of the engine construction. A principal advantage of having the aluminum die cast housing sections split along a central plane (common with the axes of the cylinders) is that upon separation of such sections, the various chambers and cases are instantly and simultaneously exposed. This is advantageous because during manufacture the water jacket itself can be directly cleared of casting fins and debris and this cleanliness verified, which heretofore has been impossible with internally cored water jacket passages. In addition, the various cases which are integrated into the clamshell sections can be arranged to define the supporting surfaces for a number of subassemblies, eliminating the necessity for separate machining and allowing such surfaces to be defined as a result of casting. For example, the camshaft case 33 is indented at 60 so as to not only reduce weight but to define cam bearing surfaces 90 for tappets 91 and supports at 61 for camshaft 92. Similarly, the crankcase has webbing members 32 which may extend to integrally define the crankshaft bearing surfaces 63. It is advantageous that such bearings be split along a vertical plane since the horizontal component of the crankshaft forces, as well as for the camshaft, are minimal during operation of the engine, and in a modern "fast burn" engine, one-fifth the crankshaft forces experienced in a vertical direction. Therefore, the horizontal separating forces, tending to pull the clamshell sections apart, are substantially lower than that experienced in an engine where the housing sections are split along a horizontal plane.

Figure 2:
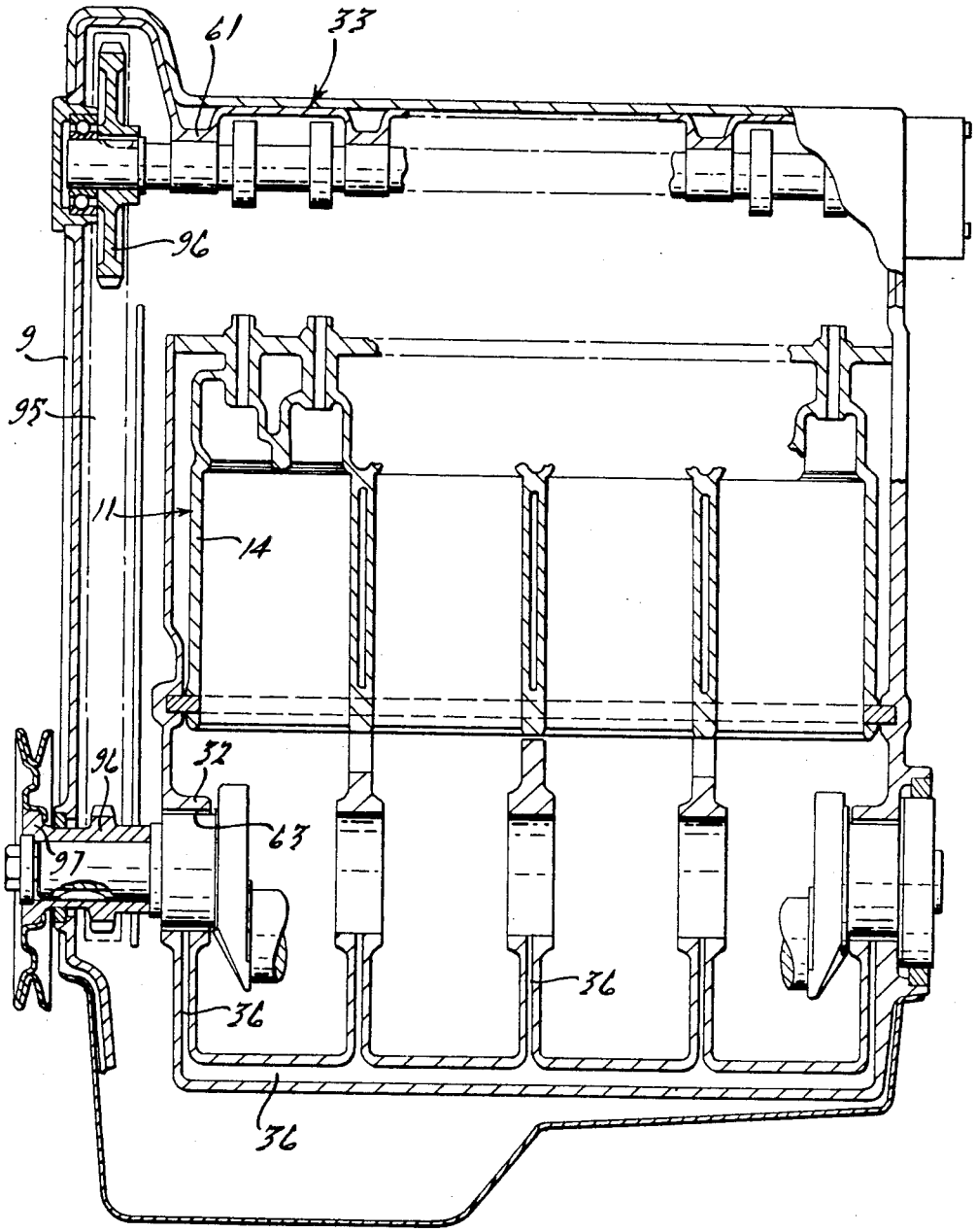
FIG. 2 is a central sectional view taken substantially along line 2—2 of FIG. 1.

An important advantage of the central plane split housing sections is the capability of defining more extensive as-cast oil distribution channels and therefore elimination of the need for separate drilling and machining operations. As shown in FIG. 2, oil gallery grooves 36 are defined along at least one of the mating margins 34–35 and extend in a peripheral manner about the crankshaft chamber and may extend along the margins of the combustion chambers, extending from a lower position where oil is delivered from an oil pump carried upwardly into the camshaft case where it is distributed downwardly along the margins to each of the camshaft bearings and thence collected in an oil gallery for return to the pump.

Water Jacket Sealing Means

A means 39 (see FIG. 1) is provided which extends between the clamshell sections and the monoblock to seal the top and bottom of the water jacket chamber (that lies outside of the central upright plane) against water migration. This comprises a pair of continuous groove loops 40–43 defined in annular lips 38–37, respectively, disposed at the upper extremity of the monoblock and at or near the lower extremity of the monoblock; each loop encircles respectively the (i) series of valve openings and valve guides, (ii) the series of in-line cylinders. Opposing compression surfaces 45–41 are defined on the clamshell sections which when mated together confront and oppose the groove loops so that O-rings 44–42, or equivalent compressible sealing members, may be interposed between such surfaces functioning to seal the separation that existed with the top of the monoblock and with the bottom of the monoblock.

Additionally, means 29 is provided to seal the periphery of the water jacket that lies in the central plane 23; an annular peripheral continuous groove 28 is defined in a mating margin of at least one of the sections (here 35) to surround the sides of the end combustion chambers and to receive a compressible sealing member 27 or a compressible O-ring. When the opposite or opposed clamshell section is pressed together with such grooved clamshell section, the mating margin 34, lying in the central upright plane, exerts a compression force to complete the sealing. Thus, there are essentially two horizontally disposed annular sealing members 42–44 and central plane oriented annular sealing members 27 which together insure the oil and water tightness of said water jacket when said sections are secured together. Preferably, the sealing members 42–44–27 may be formed as a single integral piece where 27 extends between the members 42–44 (see FIG. 4).

Joining Means for Housing Sections

Means 49 is provided to fixedly join the sections together in mated relation and comprises peripheral grooves 36 which extend around the entire housing margin 35 of section 12. The groove 36 receives bonding adhesive therein. Supplementary mechanical fastening means 48 (such as bolts) are arranged at spaced locations along the mating margins 35–34 to hold the sections tightly together and to avoid peel-mode adhesive failure. The bolts 48 are adapted to draw the sections together with a force of at least 20 psi at areas between the bolts and not immediately at the bolt.

Thrust Force Means

The sealing means 39 (comprised of grooves and resililent O-rings) has been described, up to this point, as the only connection between the monoblock and the clamshell housing sections; such connections would not permit the transfer of axial loads (resulting from combustion and piston movement) therebetween. Means 81 is provided to accomplish this. An annular radially outwardly extending flange 25 on the monoblock (see FIG. 1) is received loosely by a groove 82 in the inner waist wall of the die cast housing sections.

Considerable tolerance between the groove and flange can be provided. A wavy/flat spring 80 is inserted between the bottom flat surface 83 of the flange and the upwardly facing flat surface 84 of the groove to urge the flange upwardly to assure initial contact between flat surfaces 86 and 87 at the start of the compression stroke when the forces are upward. The power or force of wavy spring resists thrust forces to maintain a connection primarily during the intake stroke of the engine when the friction forces are downward.

Tolerance for a thermal expansion differential between the monoblock (comprised of cast iron) and the clamshell sections (comprised of aluminum) is provided by (a) wavy metallic compression or accordion sealing rings 70 deployed about each of the outlets **17*b*–18*b* of the intake elbow 17 and exhaust elbow 18, (b) a wavy metallic spring 80 and flange 25 at 81; and (c) compressible O-rings in grooves 28–40–43**.

By controlling the contact forces at flange interface 86–87 when gas pressures are low, differential thermal expansion between the monoblock and the clamshell sections can be accommodated in sliding motion at such flange location.

Assembly

The method of assembling the construction of this invention results in reductions in cost and increases quality and reliability:

1. One of the clamshell sections is placed in a horizontal position with the mating margin 35 in a horizontal disposition. Such clamshell section can serve as a receptacle for other internal components.

2. The monoblock is then independently preassembled with subassemblies including pistons and connecting rods; in some cases the crankshaft can be attached to the connecting rods if desired. This preassembly can be leak tested for ring and valve seat sealing in a separate fixture. Sealing members 42–44–27 are positioned in groove loops 40 and 43 of the monoblock. The preassembled monoblock is inserted into place in the horizontally disposed clamshell section. The preassembled monoblock can be grasped, handled and held in place using counterbores in the inlet and exhaust ports.

3. The subassembly of the camshaft and cam followers can be placed in position in the horizontally disposed monoblock and clamshell section. With the direct acting valve train using bucket tappets, the camshaft and tappets lie in or near the center line as shown in FIG. 1. With finger followers, the valve springs of each subassembly are compressed and if the valve locks are bonded to the spring retainers by weak adhesive, the valve stems will move down when the springs are compressed. Other internal components can be similarly expediently assembled.

4. Sealing O-rings are positioned in grooves 28 of the horizontally disposed clamshell section 12. Adhesive is applied to the grooves 36.

5. Finally, the right hand clamshell section 13 is closed over the clamshell section 12 containing subassemblies. Housing bolts 48 are installed to promote the proper vertical plane compression.

The above construction provides several principal advantages:

1. A centrally upright split housing reduces the need for clamping forces on the housing resulting in less housing distortion which translates into less engine friction (piston ring tension, camshaft bearings, and main crankshaft bearings) for better fuel economy. Less clamping force results in less cost and weight for the securement system.

2. The height of the centrally upright split housing provides greater rigidity which reduces powertrain bending deflections.

3. The unique structure of a centrally upright split housing minimizes the amount of iron necessary to use the one-piece wear resistant insert (called a monoblock), simplifies the iron casting by eliminating the cored water jacket walls normally required of prior art castings, and renders the coolant side of the monoblock walls accessible for inspection, flash removal and cleaning. Moreover, the unique structure permits the use of die cast aluminum for lower casting/machining cost as well as minimal volume of aluminum for lower weight and cost.

4. The use of a three-piece construction to enclose all of the engine's internal components results in a reduced number of components and therefore cost, reduces the assembly cost, reduces the probability of leakage at component interfaces, and eliminates the weight of mating flanges, fasteners and bosses required when a greater multiplicity of elements are required. Housing extension 9 for the timing chain 95 and timing sprockets 96 as well as support for the oil seal of the power takeoff wheel 97 can be made integral.

5. The use of clamshell mating housing sections along a central upright plane makes it possible to distribute the lubricating oil throughout the engine using die cast passages which close when the clamshell sections are assembled. This results in reduced machining costs, and avoids the usual need to individually clean machining debris from drilled lubricant passages.

While particular embodiments of the invention have been illustrated and described, it will be obvious to those skilled in the art that various changes and modifications may be made without departing from the invention, and it is intended to cover in the appended claims all such changes and modifications as fall within the true spirit and scope of this invention.

We claim:

1. Construction for an internal combustion engine, comprising:

(a) a cast metal wear resistant monoblock having a bank of aligned cylinders with the axes of said cylinders lying in a common central plane and each having a top, said monoblock being closed at the top of said cylinders except for means permitting ingress and egress of combustion gases to or from said cylinders;

(b) a pair of cast metal complementary clamshell housing sections having margins mateable along said central plane, said sections being effective to support and envelope said monoblock in spaced relation therein to define a water jacket chamber having a top and a bottom, said sections having a cast-in-place oil passage system defined in and along the margins mateable at said central plane;

(c) means extending between said sections and monoblock to seal said water jacket chamber against gas and water migration;

(d) means extending annularly about the monoblock and received by the housing sections to transfer cylinder axial thrust loads therebetween; and (e) means to fixedly join said sections together in said mated relationship.

2. The construction as in claim 1, in which said central plane is vertical.

3. The construction as in claim 1, in which said monoblock is comprised of a material selected from the group consisting of cast iron and ceramic.

4. The construction as in claim 1, in which said clamshell sections are comprised of die cast aluminum.

5. The construction as in claim 1, in which said means to fixedly join said sections together comprises (a) at least one annular continuous groove in the margin of one clamshell section, (b) resilient adhesive deposited in said groove, and (c) mechanical fastening means to draw said sections together to prevent the housings from separating allowing adhesive to cure and to prevent "peel-mode" failure of the cured adhesive.

6. The construction as in claim 1, in which said means to seal said water jacket chamber comprises continuous opposed surfaces disposed respectively on said sections and monoblock and located respectively close to said top and bottom of the water jacket chamber and to seal the water jacket chamber along said central plane, (b) continuous and compressible sealing members disposed between said opposed surfaces.

7. The construction as in claim 6, in which said opposed surfaces comprise (a) a continuous groove disposed adjacent said water jacket chamber top and a continuous groove disposed adjacent said water jacket chamber bottom, each located in planes transverse to said central plane, (b) a continuous lip surface opposing a groove when said sections are in the assembled position about said monoblock.

8. The construction as in claim 1, in which said means permitting ingress and egress of said combustion gases to or from said cylinders comprises (a) at least one exhaust port elbow for each cylinder terminating in a side upright plane along one side of said monoblock and at least one intake port elbow for each cylinder terminating in an upright plane along the opposite side of said monoblock, (b) a bank of valve guides having axes lying near said central plane.

9. The construction as in claim 8 in which said bank of valve guides carry a continuous annular lip which surrounds said bank of valve guides.

10. The construction as in claim 1, in which said clamshell housing sections have walls defining integral camshaft bearing surfaces.

11. The construction as in claim 1, in which said clamshell sections have walls defining integral bearing journals for a crankshaft.

12. The construction as in claim 1, in which at least one plastic member is adhesively bonded to said clamshell housing sections.

13. The construction as in claim 1, in which said sections are joined together by a joining force in the range of 30–110 psi.

14. A three piece construction for a combustion chamber, camshaft case, water jacket, timing chain case, and crankshaft case of an internal combustion engine, comprising:

(a) a cast metal monoblock defining a plurality of in-line combustion chambers along a central upright plane, said monoblock containing wear resistant surfaces for said engine, comprising cylinder bores, valve seats and valve guides;

(b) a pair of metal complementary clamshell sections having margins mateable along said central plane, said sections being effective to support and envelope said monoblock in spaced relation therein to define a water jacket chamber about said combustion chambers, said sections when separated exposing the interior of said crankshaft case, camshaft case, timing chain case, and water jacket;

(c) means extending between said sections and monoblock to seal said water jacket chamber against water migration; and (d) means to fixedly join said sections together in mated relationship.

* * * * *